US007188839B2

(12) United States Patent
Lehrer

(10) Patent No.: US 7,188,839 B2
(45) Date of Patent: Mar. 13, 2007

(54) ENTERTAINMENT GAME

(75) Inventor: Robert Lehrer, Wilmington, DE (US)

(73) Assignee: Robert Lehrer Associates, Inc., Boothwyn, PA (US)

( * ) Notice: Subject to any disclaimer, the term of this patent is extended or adjusted under 35 U.S.C. 154(b) by 155 days.

(21) Appl. No.: 10/876,076

(22) Filed: Jun. 24, 2004

(65) Prior Publication Data

US 2005/0035553 A1 Feb. 17, 2005

Related U.S. Application Data

(60) Provisional application No. 60/494,078, filed on Aug. 11, 2003.

(51) Int. Cl.
*A63F 9/18* (2006.01)

(52) U.S. Cl. ..... 273/431; 273/430; 273/429; 273/236

(58) Field of Classification Search ..... 273/429–432, 273/236, 243, 249–254
See application file for complete search history.

(56) References Cited

U.S. PATENT DOCUMENTS 4,474,557 A * 10/1984 Clossey ..... 434/153

OTHER PUBLICATIONS

"Who Wants To Be A Millionaire", Answers.com, Sep. 4, 1998, www.answers.com/topic/who-wants-to-be-a-millionaire.*
"Who Wants To Be A Millionaire" board game, spring 2000, Coverting Magazine website, www.convertingmagazine.com.*
The Price Is Right: Phone Home Game, http://gscentral.net/phone.htm, 1983.*

* cited by examiner

*Primary Examiner*—Benjamin Layno
(74) *Attorney, Agent, or Firm*—Connolly Bove Lodge & Hutz

(57) ABSTRACT

A method of playing an entertainment game includes selecting a lead participant who is required to perform at least one qualifying action in a first level of play. The lead participant is rewarded preferably by a monetary reward upon completion of the requisite number of qualifying actions in the level of play. The lead participant may select an ally from a resource pool to assist in performing the qualifying action. The ally shares with the lead participant in the reward. Preferably there are multiple levels of play with higher degrees of difficulty and with greater rewards.

33 Claims, No Drawings

ENTERTAINMENT GAME

CROSS REFERENCE TO RELATED APPLICATION

This application is based on provisional application Ser. No. 60/494,078, filed Aug. 11, 2003.

BACKGROUND OF INVENTION

Among the most popular programs appearing on television recently are "contests", most often pitting one or more of a group of players or contestants against another. Although initially there may be a moderate level of cooperation among one or more of the players, such alliances are short-lived because there can finally be only one "winner" in that type of program structure. Self-interest, scheming, mistrusts, half-truths and sometimes outright lies and treacheries are often the main characteristics of such programs. While these characteristics mimic some of the less professional characteristics of business and of overall American and like societies at this time, emphasizing them repeatedly on TV is arguably not the best direction to take for a medium with such a high degree of influence on values. Besides, one of the major roles of entertainment is to provide respite from everyday; such negative shows do nothing toward that goal.

One glimmer of hope that approached emphasizing what were once the more traditional and kinder American values of friendliness, cooperation, trust and truth first appeared a few TV seasons ago as the highly popular "Who Wants To Be A Millionaire?"™ quiz show. Since that time, what many viewers consider to be questionable format content and programming/timing decisions have unfortunately reduced the "Millionaire" quiz program to a much lower level of visibility.

SUMMARY OF INVENTION

An object of this invention is to provide an audience and/or participant entertainment game particularly adaptable for TV or radio, or for live studio audiences, or for use in other venues—which avoids cut-throat competition.

A further object of this invention is to provide such an audience entertainment game in which the players can achieve high financial success independent of the success of other players.

In accordance with this invention the entertainment game includes the possibility of permitting a player to choose whether or not to enlist the assistance of one or more persons from a resource pool-persons who in alliance with the original lead player could help to move their alliance to higher and higher reward levels. In this preferred practice of the invention no player is "kicked out" of the game. To the contrary, players get "kicked into" the game.

In general, the entertainment game would be practiced by selecting a lead participant and also by providing a resource pool containing a predetermined number of potential allies. The lead participant would be required to correctly perform at least one qualifying action and would be rewarded for performing the action, but might be disqualified for failure to perform the action. Such action could be the correct answering of a question or the performing of an act such as a physical act or a treasure hunt-type act or a task. Preferably, the performing of the action takes place at a first level of play and the lead participant would then be qualified to enter a second level of play which preferably would require a more challenging qualifying action. In this second level of play the lead participant could be permitted to be assisted by an ally selected from the resource pool. Any rewards resulting from completion of the further qualifying action could be shared by the lead participant and the ally.

The game could be practiced by more than two levels of play during which the lead participant would be able to select further allies from the resource pool.

DETAILED DESCRIPTION

The present invention is directed to an entertainment game which could be performed on TV or on the radio or could be performed for a live audience or in a parlor setting, or in any other manner so as to provide entertainment resulting from the attempt to correctly perform one or a series of qualifying acts. The term "entertainment game" is thus intended to be used in its broadest sense and could include broadcast games, audience games, parlor games, board games (both electronic and non-electronic), computer or internet games, etc. The qualifying acts may be listed on cards, such as in Trivial Pursuit™, or could be determined by a rolling of dice, or in any other manner that would be apparent given the guidelines and teachings of this invention. The rewards could be monetary or could be physical items or could be symbolic such as simply being points which would be given with or without other tangible value.

The participants of the game in a broadcast mode, for example, would preferably include a moderator and a lead participant or protagonist. In addition, there would be a resource pool which could comprise a selected number, such as seven, of persons who may have been prequalified, although not necessarily, via one or more tests and/or tasks designed and administered by the show's management so as to be eligible to be a protagonist or lead contestant or to be a member of the resource pool on the show. Typically, the resource pool would include a group which contains experts or semi-experts who could be amateurs or professionals with superior knowledge or expertise in one or more fields academically or physically. The specific expertise of each member of the resource pool group could be known to other members of the group, such as over some limited period of time and preferably prior to the start of the game. Similarly, the specific expertise could become known to the live or TV or radio or other audience and again to the then current protagonist just prior to the ally selection process. Only the people in the resource pool would be eligible to become allies during the playing of the game by being selected to assist the lead participant.

Preferably all persons who reach a resource pool would be guaranteed at least a modest, but significant reward such as a $25,000.00 payment. [The exemplary monetary values stated in this application are in U.S. dollars. Obviously, the monetary values could be in currency of other countries.] Any other payment or reward could also be used at some other appropriate level in the actual game. As later discussed, any person selected from the resource pool who actively assists the lead participant might also or alternatively gain a reward such as by sharing any prizes resulting from successful participation in the game.

In an exemplary manner of playing the audience entertainment game a protagonist or lead participant would be selected such as by computer or by lot or in any other suitable manner. The host or moderator would then welcome the lead participant. Later allies or new protagonists can be selected in the same manner or the later allies might be selected directly by the lead participant. The game might be physically played by providing a half-moon shaped table where the host is seated at the flat side with an appropriate number of chairs, such as 3 chairs, around the arcuate side. The resource pool could also be seated at a half-moon table in view of the host/player table and vice-versa.

The host would remind the lead participant and the audience of the rules and operation of the game with emphasis on the fact that players selected from the resource pool who become active members of the game would share in any rewards. Such sharing of rewards could be done equally among the group playing the game, namely the lead participant and all allies from the resource pool or could be shared in some proportionate manner such as by having the lead participant receive a greater share of the reward.

Preferably, a number of groups of questions or series of tasks such as physical tasks or treasure hunt tasks would be provided. These tasks may be considered as a qualifying action. In a preferred practice of the invention there would be qualifying actions in three levels of play, although there could be more or less than three levels. These qualifying actions would be prepared well in advance by show management and categorized by progressive difficulty for each successive level for the game. In the preferred practice of the invention the protagonist or lead participant alone must answer or successfully perform all qualifying actions in the first level in order to move ahead in the game. It is to be understood, however, that even at the first level the game may be played where the lead participant may seek assistance from an ally in the resource pool.

In a further variation, the invention can be practiced where each ally may assist the lead participant a predetermined number (such as one or two) of times in any level. There could be a limit, or no limit, on the number of allies in each level and/or each game.

Each qualifying action in the first level would have a value such as, for example, $25,000.00. If there were seven qualifying actions in Level 1 the total possible earnings for correctly performing each qualifying action in Group 1 would be $175,000.00. The game may be practiced, however, where there is only one qualifying action or any number even if in excess of seven. Three, four or five numbers would be quite suitable. The number of qualifying actions could be the same or could be different for some or all of the levels. Preferably the qualifying actions of Level 1 would be of a general nature and would be recommended to be of moderate or lower difficulty, although qualifying actions at any level of difficulty could be used. The invention could be practiced where the types of qualifying actions within a level or from one level to another level increase/decrease in difficulty or are of the same difficulty and/or are the same or of a differing type of qualifying action.

If the lead participant or protagonist fails Level 1, a new protagonist would be chosen from the resource pool and new Level 1 type qualifying actions would be conducted. The failed protagonist could be eliminated from further play or could be entered into the resource pool and be available for selection as an ally. Preferably, however, the failed protagonist would not qualify as a new protagonist, although the game could be played where even a failed protagonist could again be a lead participant. Preferably, no earnings or rewards would be retained in the game bank if any protagonist fails to qualify from the Level 1 qualifying actions.

When a protagonist or lead participant succeeds in Level 1 the protagonist then has the option of requesting an ally from the resource pool to help perform the qualifying actions for Level 2. Alternatively the protagonist could elect to go it alone through Level 2 or the protagonist could elect to seek an ally from the resource pool when partially through Level 2. At the time of ally selection the host would announce the subject matter or matters of the Level 2 qualifying actions which may or may not match the expertise of any remaining member of the resource pool. If any ally is selected that person takes a place at the host table. In this instance the earnings from the Level 1 qualifying actions are placed in the game bank as the initial pool of winnings to be eventually shared within the alliance then comprising the lead participant and all selected allies. Alternatively, the earnings from Level 1 may be given solely to the lead participant where only the lead participant had performed the qualifying actions of Level 1.

Preferably the Level 2 qualifying actions would have a higher value than each qualifying action of Level 1. Thus, for example, where each qualifying action of Level 1 has a value of $25,000.00, the qualifying action in Level 2 might have a value of $75,000.00 with a maximum total for Level 2 with seven qualifying actions to be $525,000.00. The protagonist and any and/or all allies may confer and cooperate with each other in any way they see fit to deal successfully with the Level 2 qualifying actions. The game may include a time limit of, for example, one minute imposed to reach a response or perform any Level 2 qualifying action. The time could start when the host starts the "clock" just after revealing the qualifying action. In the example game only the protagonist would actually respond to or perform the qualifying action, particularly where the qualifying action is answering a question. The qualifying actions of Level 2 are preferably more difficult than those of Level 1, but the difficulty level would be a choice made by the show management. Failure of the alliance to successfully complete the Level 2 qualifying actions would result in all of the allies leaving the show or alternatively returning to the resource group. In failure the allies would share only the earnings in the bank which could be the earnings from the Level 1 success or the later accumulated earnings from Level 2 attained for successful completion of qualifying actions. A variation would be that there would be no addition to the game bank from Level 2 unless all of the qualifying actions in Level 2 are responded to correctly or adequately.

Failure to totally respond correctly to the Level 2 qualifying actions would result in the selection of a new protagonist from the remaining resource pool members. In the preferred practice a previous protagonist would be ineligible to again be chosen as a protagonist but may be selected as an ally. Upon selection of a new protagonist a new game would start.

If the Level 2 qualifying actions are successfully completed or performed, the then current protagonist with advice from the ally, if any, may request a second (or first) ally from the resource pool. A time limit, such as one minute, might then be allowed for the players to reach and announce their decision of whether or not to add an ally. A variation would be to permit an ally to be added during the course of qualifying acts of the level, such as before any specific qualifying act must be done. Preferably, the host will have announced the subject matter or matters of the qualifying actions of any level prior to the start of the clock.

In all successful Level 2 qualifying action response in the example game the earnings are added to the game bank for eventual sharing as winnings. In this example the money pool would become a maximum of $700,000.00.

The protagonist and the allies which preferably would be either none, one or two, depending on the choices made, would be seated opposite the host and would then take on the Level 3 qualifying actions. These qualifying actions are preferably of higher difficulty or complexity. A variation in the performing of the Level 3 qualifying actions (such as where there are seven qualifying actions) would be to allow a selected number of, preferably a low number, such as one, incorrect responses and yet permit the game to continue with that protagonist and allies. A larger number of, such as two, incorrect qualifying action responses in this example would end the game.

Where the game has three levels such as Level 1, Level 2 and Level 3, each Level 3 qualifying action could have a value of, for example, $225.000.00 with a maximum total of $1,075,000.00. The total possible earnings in the game bank, in this example, reach $2,275,000.00. A variation would be to provide a bonus which could be termed as an income tax bonus comparable to the tax rate, such as 33% that would be required for the total winnings where any alliance properly performs every qualifying action. In this example, where there are seven qualifying actions in each of three levels this would mean that all 21 qualifying actions must be successfully performed in order to obtain the bonus to offset the income tax. A variation would be to make a deposit or reward in the game bank after each correct performance of the qualifying action rather than requiring all or a predetermined number of qualifying actions to be performed and then make the deposit or reward in the game bank at the end of the level session. This could be done solely for Level 3 or for any or all of the levels. The game could similarly be played with more or with less than three levels.

In the example previously described regarding the specified amounts of rewards and the specified numbers of qualifying actions, an alliance reaching the third level (Level 3) would have guaranteed winnings in a minimum amount equal to the game bank at the end of Level 2 and a maximum of $2,275,000.00 plus any bonus. Again the game rules could be that the game bank money would be divided among the active alliance, preferably equally divided. In the preferred practice a second incorrect response or performance of the qualifying action in Level 3 would result in the game being over and in the alliance sharing the game bank total then earned. Each participant remaining in the resource pool at the end of the game would receive the minimum compensation. When the game ends another game may be started at the show management's option with the choice of a new protagonist.

The entertainment game can be performed with a number of variations. For example, a different type of qualifying action, i.e., a question or a physical activity or a treasure hunt or task, etc. could be required for each level. Thus, for example, the first level might involve qualifying actions which are all questions. The qualifying actions of Level 2 might involve the performance of certain physical activities or tasks. The qualifying actions of Level 3 might involve treasure hunt activities or tasks. Alternatively, a mixture of such qualifying actions could be in any or all levels. The number of qualifying actions could vary from a minimum of one to any number which is practical, such as seven in the current example; the degree of difficulty would increase at each level. While the preferred practice of the invention would involve the reward at the completion of a level to be of a monetary nature, the reward could simply be the permitting of the participant to enter the next level. The selection of allies could be mandatory or could be optional. Where allies are selected the lead participant could make the selection or the selection could be done in any other manner, such as in a random fashion or by the host or in the order of seating or by audience voting. Where the qualifying actions in a particular level are all of the same type or category, such as questions relating to history or activities involving calculations or physical dexterity, etc. the category could be made known before an ally selection is made or after an ally selection is made. When the qualifying actions in a level are varied in nature, all categories would be made known before any ally selection. The qualifying actions could be such that would require immediate performance such as the answering of a question or the performance of a physical activity or could be permitted to be accomplished over a period of time such as by the next program session where, for example, the qualifying action might involve a treasure hunt or other task requiring time for its completion.

The invention may also be practiced where a plural number of allies are selected at the same time to assist in playing the game at one or more levels or where a plural number of allies are selected within a level of play with the selection being made periodically during a level, such as before each qualifying action.

Where a game involves qualifying actions which are time consuming, a new game could be started using new participants while the qualifying actions (e.g. a treasure hunt or an endurance athletic event) of the prior game are being performed. Thus, multiple games may be simultaneously played. Similarly, even where qualifying actions are not time consuming, one game could be interrupted, such as at the completion of one level, to permit another game to be played so that two or more games would be played simultaneously. Another variation would be to have multiple games played at exactly the same time such as at different locations of a room or in different rooms. This would lend itself to parlor games or to live audience games.

Other variations to the entertainment game of this invention will be apparent to those of ordinary skill in the art given the guidelines and suggestions made herein.

What is claimed is:

1. A method of playing an entertainment game comprising selecting a lead participant, providing a resource pool of a plurality of potential allies, requiring the lead participant to correctly perform at least one type of qualifying action in at least two levels of play, rewarding the lead participant for performing the action and disqualifying the lead participant for failure to perform the action, permitting an ally from the resource pool to assist the lead participant in the level of play, when an ally is picked the ally becoming and remaining a co-participant throughout the remainder of the game where further actions are required to the conclusion of the game, and at the conclusion of the game (a) rewarding both the lead participant and tire ally with a tangible reward having monetary value upon correct completion of at least one qualifying action when an ally assists the lead participant so that the reward is split between the lead participant end the ally and (b) rewarding solely the lead participant when no ally is ever picked during the game and the lead participant thereby solely performs the qualifying action.

2. The method of claim 1 wherein the qualifying action is selected from the group of types consisting of a combination of answering a question, performing a physical act, participating in a treasure hunt, performing a physical task, and performing an intellectual task.

3. The method of claim 1 wherein the resource pool comprises persons who have been prequalifed based upon at least some level of expertise relating to possible qualifying actions.

4. The method of claim 3 wherein the lead participant is aware of the area of expertise of the persons in the resource pool.

5. The method of claim 3 wherein a category or categories of qualifying actions in a level of play is announced prior to an ally selection.

6. The method of claim 3 wherein a category or categories of qualifying actions in a level of play is announced subsequent to an ally selection.

7. The method of claim 1 wherein each successive level of play is at least equal to the degree of difficulty in its qualifying actions as in the prior level of play.

8. The method of claim 1 wherein there are a plurality of qualifying actions in each level of play.

9. The method of claim 8 wherein a reward is awarded upon the successful completion of a level of qualifying actions.

10. The method of claim 9 wherein a successful completion of a level of play requires the correct performance of all qualifying actions in that level.

11. The method of claim 9 wherein a successful completion of a level of play requires the correct performance of at least one qualifying action in that level and permits the incorrect performance of a preselected number of qualifying actions.

12. The method of claim 9 wherein a bonus reward is awarded when all qualifying actions in all levels of play are successfully performed.

13. The method of claim 8 wherein the qualifying actions of a level of play differ from the type of qualifying actions in at least one other level of play.

14. The method of claim 8 wherein the qualifying actions of a level of play are of the same type as in at least one other level of play.

15. The method of claim 8 wherein the qualifying actions in each level of play comprise different types of qualifying actions within that level.

16. The method of claim 1 wherein a lead participant who is disqualified for failure to successfully complete a level of play is entered into the resource pool for availability as an ally in a further playing of the game but is disqualified from again being a lead participant.

17. The method of claim 1 wherein a successful completion of a first level of play requires successful performance of all qualifying actions in the first level of play, and wherein a successful completion of a second level of play permits at least one incorrect performance of the qualifying actions in the second level of play.

18. The method of claim 1 wherein an ally may be selected in the first level of play.

19. The method of claim 1 wherein after completion of the game a new game is started using a person from the resource pool as the lead participant.

20. The method of claim 1 wherein the ally is selected by the lead participant.

21. The method of claim 1 wherein the ally is selected in some manner other than selection by the lead participant.

22. The method of claim 1 wherein the reward for completing a requisite number of qualifying actions in a level of play is a monetary award.

23. The method of claim 22 wherein each level of play has qualifying actions of greater difficulty than the preceding level and each level of play having a greater reward than the proceeding level.

24. The method of claim 1 wherein at least one level of play has the same number of qualifying actions as at least one other level of play.

25. The method of claim 1 wherein at least one level of play has a different number of qualifying actions than at least one other level of play.

26. The method of claim 1 wherein the type of qualifying action in at least one level of play is the same as in at least one other level of play.

27. The method of claim 1 wherein the type of qualifying action in at least one level of play is different than in at least one other level of play.

28. The method of claim 1 wherein there is a predetermined limit on the number of allies that may be used in at least one level of play and/or game.

29. The method of claim 1 wherein there is no limit on the number of allies that may be used in any level of play and/or game.

30. The method of claim 1 wherein the game is an audience entertainment game selected from the group consisting of a television broadcast, a radio broadcast and a live audience viewing.

31. The method of claim 1 wherein the entertainment game is selected from the group consisting of parlor games, board games, computer games and internet games.

32. The method of claim 1 wherein the qualifying action is selected from the group of types consisting of performing a physical act, participating in a treasure hunt, performing a physical task, and combinations thereof.

33. The method of claim 1 wherein when an ally becomes a co-participant both the lead participant and the co-participant jointly participate in the manner of performing a qualifying action and in any selection of a further ally in a further level of play and the lead participant and all allies split the reward.

* * * * *

UNITED STATES PATENT AND TRADEMARK OFFICE

CERTIFICATE OF CORRECTION

PATENT NO. : 7,188,839 B2
APPLICATION NO. : 10/876076
DATED : March 13, 2007
INVENTOR(S) : Robert Lehrer It is certified that error appears in the above-identified patent and that said Letters Patent is hereby corrected as shown below:

In the listing of references cited in reference to "OTHER PUBLICATIONS" line 4, "Coverting" should be --Converting--;

Col. 2, line 3 "could" should be --would--;

Col. 2, line 57 "might" should be --would--;

Col. 3, line 37 "Group" should be --Level--;

Col. 4, line 59 "response" should be --responses--;

In the Claims:

Claim 1, at column 6, line 49, "tire", should be --the--;

Claim 1, at column 6, line 53, "end", should be --and--;

Signed and Sealed this

Twenty-third Day of October, 2007

JON W. DUDAS
*Director of the United States Patent and Trademark Office*